US006346355B2

(12) United States Patent
Sugai et al.

(10) Patent No.: US 6,346,355 B2
(45) Date of Patent: Feb. 12, 2002

(54) ELECTROPHOTOSENSITIVE MATERIAL

(75) Inventors: Fumio Sugai; Yoshio Inagaki, both of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/808,129

(22) Filed: Mar. 15, 2001

(30) Foreign Application Priority Data

Mar. 28, 2000 (JP) ..... 2000-092930

(51) Int. Cl.[7] ..... G03G 5/047

(52) U.S. Cl. ..... 430/58.25; 430/56; 430/72; 430/83

(58) Field of Search ..... 430/56, 58.25, 430/71, 72, 83

(56) References Cited

FOREIGN PATENT DOCUMENTS

| | | |
|---|---|---|
| JP | 1-206349 | 8/1989 |
| JP | 6-342219 | * 12/1994 |
| JP | 7-261419 | 10/1995 |
| JP | 09-151157 | 10/1997 |

OTHER PUBLICATIONS

Tsukamoto et al, *Tetrahedron Letters*, 40 (1999), 4691–4692.*

Derwent Abstract Acc. No. 1995–064306 describing JP6–342219, 1996.*

* cited by examiner

*Primary Examiner*—Janis L. Dote
(74) *Attorney, Agent, or Firm*—Smith, Gambrell & Russell, LLP

(57) ABSTRACT

The present invention relates to an electrophotosensitive material comprising a conductive substrate and a photosensitive layer formed on the substrate, the photosensitive layer containing a quinone derivative represented by the general formula (1):

(1)

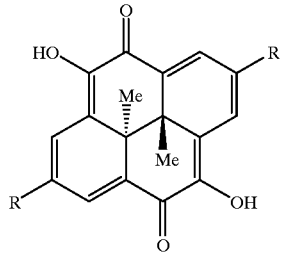

wherein R represents hydrogen atom or alkyl; Me represents methyl. The electrophotosensitive material has high sensitivity, since quinone derivative (1) has excellent electron acceptability, comparability with binder resin and matching with electric charge generating material.

4 Claims, No Drawings

ELECTROPHOTOSENSITIVE MATERIAL

BACKGROUND OF THE INVENTION

The present invention relates to an electrophotosensitive material containing a quinone derivative having an excellent electric charge transferability, which is used in image forming apparatuses such as electrostatic copying machine, facsimile and laser beam printer.

In the image forming apparatuses, a so-called organic photosensitive material has widely been used, which comprises an electric charge generating material generating an electric charge under light radiation, an electric charge transferring material transferring thus generated electric charge and a binder resin constituting a layer in which the above substances are dispersed.

The organic photosensitive material is divided into tow main classes of a single-layer type photosensitive material wherein an electric charge generating material and an electric charge transferring material are dispersed in the same photosensitive layer and a multi-layer type photosensitive material having a laminated structure of an electric charge generating layer containing an electric charge generating material and an electric charge transferring layer containing an electric charge transferring material. Further, in the multi-layer type photosensitive material, the electric charge transferring layer having a film thickness larger than that of the charge generating layer is deposited at the outermost layer of the photosensitive material in view of the mechanical strength.

The electric charge transferring material used in these photosensitive materials includes a hole transferability type one and an electron transferability type one, and among the electric charge transferring materials known until now almost all of electric charge transferring materials having high carrier mobility so as to provide practically useful sensitivity with the photosensitive material have hole transferability. Therefore, in the organic photosensitive material which is now put into practical use, the multi-layer type photosensitive material comprises the electric charge transferring layer at the outermost layer becomes a negatively charging type one inevitably.

However, this negatively charging type organic photosensitive material must be charged by negative corona charge accompanied with the generation of a large amount of ozone, thereby to cause problems such as influence on the environment and deterioration of the photosensitive material itself.

To solve the problems described above, it has been studied to use an electron transferring material as the electric charge transferring material.

Japanese Published Unexamined Patent Application (Kokai Tokkyo Koho Hei) No. 1-206349 suggests to use, as the electron transferring material, a compound having a structure of diphenoquinone or benzoquinone.

However, a compound having diphenoquinone structure or benzoquinone structure is poor in matching with the electric charge generating material and insufficient in injection of electrons into the electron transferring material from the electric charge generating material. Since such an electron transferring material has low compatibility with a binder resin and is not uniformly dispersed in a photosensitive layer, the hopping distance of electrons becomes longer and electrons are less likely to move at low electric field.

Accordingly, as is apparent from electrical characteristics test described in Examples described hereinafter, the above-described conventional photosensitive material containing an electron transferring material had problems such as high residual potential and poor sensitivity.

The single-layer photosensitive material has advantages that one photosensitive material can be used in both of positively and negatively charging type apparatuses by using electron and hole transferring materials in combination. However, there arise problems that, when using diphenoquinone derivative as the electron transferring material, a charge transfer complex is formed by an interaction between the electron and hole transferring materials, thereby inhibiting transfer of electrons and holes.

To solve the problems described above, Japanese Published Unexamined Patent Application (Kokai Tokkyo Koho Hei) Nos. 7-261419 and 9-151157 disclose to use a naphtoquinone derivative as the electron transferring material.

However, even when using a naphthoquinone derivative as the electron transferring material, it is not sufficient in matching with the electron generating material and in compatibility with a binder resin.

SUMMARY OF THE INVENTION

Thus, an object of the present invention is to solve the technical problems described above and to provide an electrophoto sensitive material whose sensitivity has been improved as compared with a conventional one.

While studying intensively to solve the problems described above, the present inventors have found a new fact that: a quinone derivative represented by the general formula (1) [hereinafter referred to as "quinone derivative (1)"]:

(1)

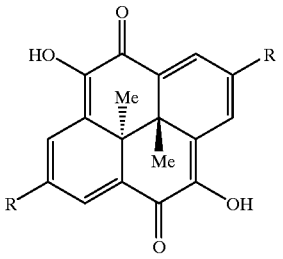

wherein R represents a hydrogen atom or an alkyl group having 3 to 6 carbon atoms and Me represents a methyl group, has higher electron transferability as compared with a conventional electron transferring material such as a compound having diphenoquinone structure or benzoquinone structure. Quinone derivatives of the general formula (1) are known compounds described in Tetrahedron Letters 40 (1999) 4691–4692.

Thus, the present invention includes the following inventions.

1) An electrophotosensitive material comprising a conductive substrate and a photosensitive layer formed on the conductive substrate, the photosensitive layer containing a quinone derivative represented by the general formula (1).

2) The electrophotosensitive material according to the above item 1), wherein said photosensitive layer contains an electron acceptor.

3) The electrophotosensitive material according to the above item 1), wherein said photosensitive layer is a single-layer type one contains at least a binder resin, an electric charge generating material and a hole transferring material, and 5 to 100 parts by weight of said quinone derivative represented by the general formula (1) based on 100 parts by weight of the binder resin.

4) The electrophotosensitive material according to the above item 1), wherein said photosensitive layer comprises at least an electric charge generating layer and an electric charge transferring layer which contains at least a binder resin and 5 to 100 parts by weight of said quinone derivative represented by the general formula (1) based on 100 parts by weight of the binder resin.

Said quinone derivative (1) has excellent electron acceptability and further good compatibility with a binder resin, thereby making it possible to uniformly disperse in the binder resin. Furthermore, quinone derivative (1) is superior in matching with the electric charge generating material and injection of electrons from the electric charge generating material is smoothly conducted. Accordingly, quinone derivative (1) exhibit excellent electric charge transferability even at low electric field and are suited for use as the electron transferring material in the electrophotosensitive material.

The electrophotosensitive material of the present invention has high sensitivity because of containing said quinone derivative as electron transferring material.

Moreover, since quinone derivative (1) does not form a charge transfer complex with the hole transferring material, they are used particularly preferably in the single-layer typephotosensitive layer using the electron transferring material in combination with the hole transferring material.

The electrophotosensitive material of the present invention is characterized in that the photosensitive layer is formed on the conductive substrate and said photosensitive layer contains one or more of quinone derivatives represented by the general formula (1).

Since such electrophotosensitive material contains quinone derivative (1) which has excellent properties as described above in the photosensitive layer, the residual potential is lower and the sensitivity is higher as compared with those of the electrophotosensitive material containing conventional electron transferring material.

Thus, the photosensitive layer containing quinone derivative (1) is superior in electron transferability at low electric field and less likely to cause recombination ratio of electrons and holes in the photosensitive, whereby apparent electric charge generation efficiency approaches an actual value. As a result, the sensitivity of the photosensitive material containing such photosensitive is improved. The residual potential of the photosensitive material is also lowered, thereby improving the stability and durability on repeated exposure.

Since quinone derivative (1) does not form a charge transfer complex with the hole transferring material as described above, a photosensitive material having higher sensitivity can be obtained when using them in a single-layer type photosensitive material containing the electron transferring material and hole transferring material in the same photosensitive layer.

In case that quinone derivative (1) is in the amount of less than 5 parts by weight, the residual potential becomes higher, thereby it is feared that the sensitivity becomes insufficient; in case the amount of more than 500 parts by weight, thereby making quinone derivative (1) possible to crystallize and the electrophotosensitive material does not sufficiently exhibit its function.

In the electrophotosensitive material of the single-layer type, quinone derivative (1) is preferably incorporated in the amount within a range from 5 to 100 parts by weight, and more preferably from 10 to 80 parts by weight, based on 100 parts by weight of the binder resin.

In the electrophotosensitive material of the multi-layer type, it comprises an electric charge generating layer containing an electric charge generating material and an resin binder and a electric charge transferring layer containing quinone derivative (1). In the multi-layer type one, quinone derivative (1) is preferably incorporated in the amount within a range from 10 to 500 parts by weight, and more preferably from 25 to 100 parts by weight, according to the same reason in the single-layer type one.

Moreover, in case that an electric acceptor is incorporated in said photosensitive layer, since the electron transferability is improved much further, the photosensitive material having higher sensitivity can be obtained.

DETAILED DESCRIPTION OF THE INVENTION

Firstly, said quinone derivative (1) is explained in detail.

In the general formula (1), examples of the alkyl group corresponding to the substituent R includes n-propyl, isopropyl, n-butyl, isobutyl, s-butyl, t-butyl, n-pentyl, isopentyl, neopentyl and hekxyl groups having 3 to 6 carbon atoms. When the carbon atom number is not more than 2, the sensitivity becomes insufficiently, and when the carbon atom number is not less than 7, there is a fear that quinone derivative (1) crystallizes since the compatibility with the binder resin becomes insufficient.

Secondly, an example of synthesizing the quinone derivative represented by the general formula (1) is explained below:

Quinone derivative (1) can be synthesized according to a method described in Tetrahedron Letters 40 (1999) 4691–4692 as explained below.

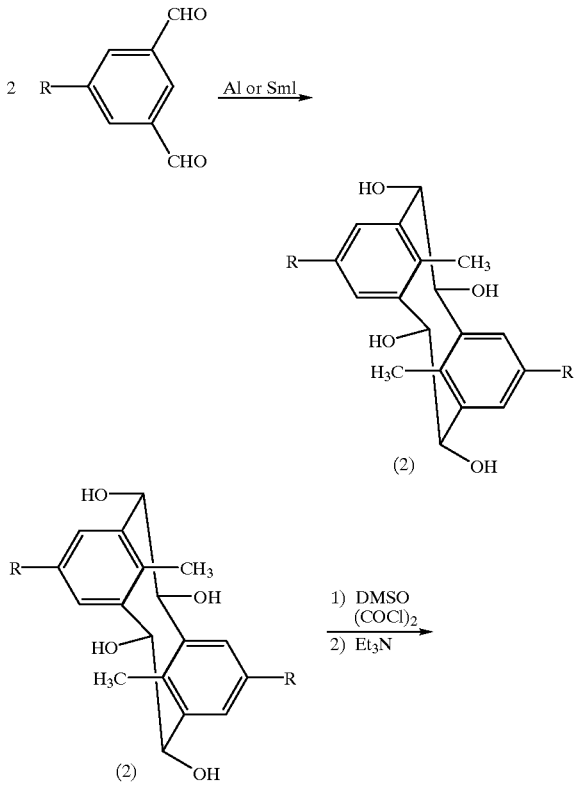

-continued

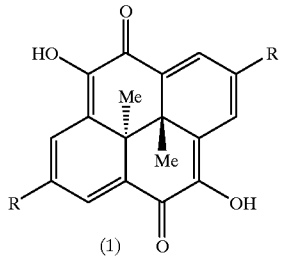

(1)

Wherein R represents hydrogen atom or an alkyl group having 3 to 6 carbon atoms and Me represents a methyl group.

Reaction scheme (I) shows that the compound (2) is reacted in dichloromethane solution containing oxalyl chloride $(COCl)_2$ and dimethyl sulfoxide (DMSO), and then $Et_3N$(wherein Et represents an ethyl group ) is added to the resulting reaction solution to obtain quinone derivatives represented by the general formula (1). Said quinone derivatives can be obtained efficiently according to the above method.

Thirdly, the electrophotosensitive material of the present invention is explained below:

The electrophotosensitive material of the present invention comprises forming a photosensitive layer, which contains a quinone derivative represented by the general formula (1) as the electron transferring material, on a conductive substrate. The photosensitive layer can be applied to any of the single-layer type and multi-layer type photosensitive materials.

The single-layer type photosensitive material is produced by forming a single photosensitive layer containing at least one of quinone derivatives represented by the general formula (1) as the electron transferring material, an electric charge generating material and a binder resin on a conductive substrate. Such a single-layer type photosensitive layer can be applied to any of positively and negatively charging type photosensitive materials with a single construction, but is preferably used in the positively charging type photosensitive material which does not require a negative corona charge. This single-layer type photosensitive material has advantages such as easy production due to simple structure, inhibition of film defects on formation of layers, and improvement in optical characteristics due to fewer interfaces between layers.

Regarding the single-layer type photosensitive material using quinone derivative (1) as the electron transferring material in combination with the hole transferring material having excellent hole transferability, since an interaction between quinone derivative (1) and the hole transferring material does not occurs, the transfer of electrons and that of holes can be efficiently conducted even if both transferring materials are incorporated in the same photosensitive layer. Therefore, a photosensitive material having high sensitivity can be obtained.

Moreover, the single-layer type photosensitive material incorporated an electron acceptor together with quinone derivative (1) is much more improved in the electron transferability, thereby to obtain the photosensitive material having higher sensitivity.

On the other hand, the multi-layer type photosensitive material is produced by laminating an electric charge generating layer containing an electric charge generating material and an electric charge transferring layer containing an electric charge transferring material on a conductive substrate in this or reverse order. Since the electric charge generating layer has a very thin film thickness as compared with the electric charge transferring layer, it is preferred that the electric charge generating layer is formed on the conductive substrate and the electric charge transferring layer is formed thereon to protect the electric charge generating layer.

The charging type (positively or negatively charging) of the multi-layer type photosensitive layer is selected depending on the formation order of the electric charge generating layer and electric charge transferring layer and the kinds of the electric charge transferring material used in the electric charge transferring layer. In the layer construction wherein the electric charge generating layer is formed on the conductive substrate and the electric charge transferring layer is formed thereon, when using the electron transferring material such as quinone derivative (1) as the electric charge transferring material in the electric charge transferring layer, a positively charging type photosensitive material is obtained. In this case, a hole transferring material or an electron transferring material may be incorporated in the electric charge transferring layer. Hereto, when incorporating an electron acceptor into said electric charge transferring layer, since the electron transferability is improved, the multi-layer photosensitive material having higher sensitivity can be obtained.

In the layer construction described above, when using the hole transferring material as the electric charge transferring material in the electric charge transferring layer, a negatively charging type photosensitive material is obtained. In this case, the electric charge generating layer may contain quinone derivative (1) or an electron acceptor in the electric charge generating layer.

As described above, although the electphotosensitive material of the present invention can be applied to any of the single-layer type or multi-layer type photosensitive materials, the single-layer type is preferred in consideration that any of positively or negatively charged type can be applied, the structure is simple and the production is easy, the film deficiency is inhibited when forming the layer, the optical properties are improved since the interface between layers is small and so on.

The electric charge generating material, hole transferring material, electron acceptor and binder resin used in the electrophotosensitive material of the present invention are as follows.

[Electric Charge Generating Material]

As the electric charge generating material used in the present invention, there can be used, for example, organic photoconductive materials such as various phthalocyanine pigment, polycyclic quinone pigment, azo pigment, perylene pigment, indigo pigment, quinacridone pigment, azulenium salt pigment, squalilium pigment, cyanine pigment, pyrylium dye, thiopyrylium dye, xanthene dye, quinoimine color, triphenylmethane color, styrylcolor anthanthrone pigment, threne pigment, toluidine pigment and pyrrazoline pigment; and inorganic photoconductive materials such as selenium, tellurium, amorphous silicon and cadmium sulfide. These electric charge generating materials can be used alone or in combination of 2 or more.

A photosensitive material having the sensitivity within a wavelength range of 700 nm or more is required in digital optical image forming apparatuses using a light source such as semiconductor laser, for example, laser beam printer and facsimile. Therefore, phthalocyanine pigments such as metal-free phthalocyanine represented by the following formula (CG-1):

(CG-1)

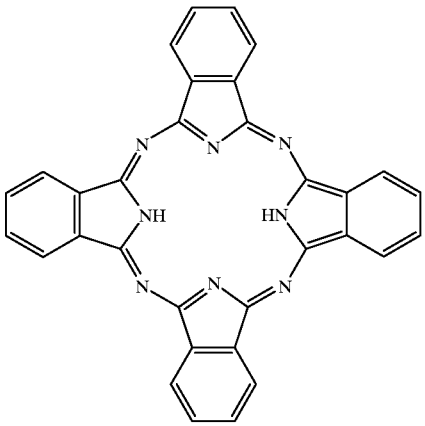

and metal phthalocyanines such as oxotitanyl phthalocyanine represented by the following formula (CG-2):

(CG-2)

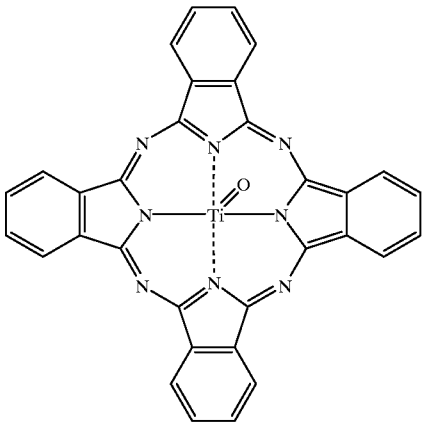

are preferably used. The crystal form of the phthalocyanine pigments is not specifically limited and those having different crystal forms can be used.

On the other hand, a photosensitive material having the sensitivity within a visible range is required in analogue optical image forming apparatuses using a white light source such as halogen lamp. Therefore, perylene pigments represented by the following formula (CG-3):

(CG3)

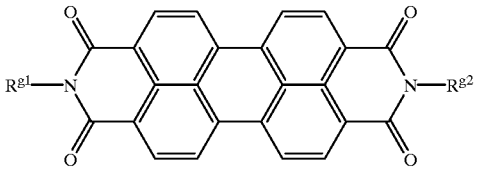

wherein $R^{g1}$ and $R^{g2}$ are the same and represent substituted or unsubstituted alkyl group, cycloalkyl group, aryl group, alkanoyl group having not more than 18 carbon atoms, and bisazo pigments are preferably used.

[Hole Transferring Material]

As the hole transferring material used in the present invention, there mentioned various compounds having high hole transferability, for example, nitrogen containing cyclocyclic compunds or condensation polycyclic compounds such as oxadiazole compounds [e.g. 2,5-di(4-methylaminophenyl)-1,3,4-oxadiazole], styryl compounds [e.g. 9-(4-diethylaminostyryl)anthracene], carbazole compounds [e.g. poly-N-vinylcarbazole], organopolysilane compound, pyrazoline compounds [e.g. 1-phenyl-3-(p-dimethylaminophenyl)pyrazoline], hydrazone compounds, triphenylamine compounds, indole compounds, oxazole compounds, isoxazole compounds, thiazole compounds, thiadiazole compounds, imidazole compounds, pyrazole compounds, triazole compounds and stylbene compounds.

In the present invention, these hole transferring materials can be used alone or in combination of 2 or more. When using the hole transferring material having a film forming property such as polyvinylcarbazole, a binder resin is not required necessarily.

[Electron Acceptor]

In the electrophotosensitive material of the present invention, an electron acceptor may be incorporated in the photosensitive layer together with quinone derivative (1) which is an electron transferring material.

As the electron acceptor used in the present invention, there mentioned various compounds having high electron transferability, for example, such as naphtoquinone compounds, benzoquinone compounds, diphenoquinone compounds, malononitrile compounds, thiopyrane compounds, tetracyanoethylenecyanoethylene, 2,4,8-trinitrothioxantone, dinitrobenzene, dinitroanthracene, dinitroacridine, nitroanthraquinone, dinitroanthraquinone, succinic anhydride, maleic anhydride, dibromo maleic anhydride and so on. In the present invention, these electron acceptors can be used alone or in combination of 2 or more.

[Binder Resin]

The binder resin in which the above respective components are dispersed, there can be used various resins which have hitherto been used in the photosensitive layer. Examples thereof include thermoplastic resins such as styrene-butadiene copolymer, styrene-acrylonitrile copolymer, styrene-maleic acid copolymer, acrylic copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyallylate, polysulfone, diallyl phthalate polymer, ketone resin, polyvinyl butyral resin, polyether resin and polyester resin; crosslinkable thermosetting resins such as silicone resin, epoxy resin, phenol resin, urea resin and melamine resin; and photocuring resins such as epoxy acrylate and urethane acrylate. These binder resins can be used alone or in combination of 2 or more.

In addition to the above respective components, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated in the photosensitive layer as far as electrophotographic characteristics are not adversely affected. To improve the sensitivity of the photosensitive layer, for example, known sensitizers such as terphenyl, halonaphthoquinones and acenaphthylene may be used in combination with the electric charge generating material.

The method of producing the electrophotosensitive material of the present invention will be described below. In the single-layer type photosensitive material, the electric charge material may be incorporated in the amount within a range from 0.1 to 50 parts by weight, and preferably from 0.5 to 30 parts by weight, based on 100 parts by weight of the binder resin. The quinone derivative (electron transferring materials) represented by the general formula (1) is incorporated in the amount within a range from 5 to 100 parts by weight, and preferably from 10 to 80 parts by weight, based on 100 parts by weight of the binder resin.

In case the electron acceptor is incorporated in said photosensitive layer, the electron acceptor is incorporated in the amount within a range from 0.1 to 40 parts by weight, and preferably from 0.5 to 20 parts by weight, based on 100 parts by weight of the binder resin. In case the hole transferring material is incorporated in said photosensitive layer, the hole transferring material is incorporated in the amount within a range from 5 to 500 parts by weight, and preferably from 25 to 200 parts by weight, based on 100 parts by weight of the binder resin. The thickness of the photosensitive layer in the single-layer type photosensitive material is within a range from 5 to 100 $\mu$m, and preferably from 10 to 50 $\mu$m.

In the multi-layer type photosensitive material, the electric charge generating material and binder resin, which constitute the electric charge generating layer, can be incorporated in various ratios, but the electric charge generating material may be incorporated in the amount within a range from 5 to 1000 parts by weight, and preferably from 30 to 500 parts by weight, based on 100 parts by weight of the binder resin. When the hole transferring material or the electron acceptor is incorporated in the electric charge generating layer, the hole transferring material or the electron acceptor may be incorporated in the amount within a range from 0.1 to 100 parts by weight, and preferably from 0.5 to 100 parts by weight, based on 100 parts by weight of the binder resin.

The electron transferring material and binder resin, which constitute the electric charge transferring layer, can be incorporated in various ratios as far as the transfer of the electric charges is not adversely affected and crystallization does not occur. The electron transferring material is preferably incorporated in the amount within a range from 10 to 500 parts by weight, and particularly from 25 to 100 parts by weight, based on 100 parts by weight of the binder resin, so that the electric charges generated by light irradiation in the electric charge generating layer can be transferred easily. In case the electron acceptor is incorporated in the electric charge transferring layer, the electron acceptor may be incorporated in the amount within a range from 0.1 to 40 parts by weight, and preferably from 0.5 to 20 parts by weight, based on 100 parts by weight of the binder resin. When the hole transferring material is incorporated in the electric charge transferring layer, the hole transferring material may be incorporated in the amount within a range from 5 to 200 parts by weight, and preferably from 10 to 80 parts by weight, based on 100 parts by weight of the binder resin.

A barrier layer may be formed between the conductive substrate and photosensitive layer in the single-layer type photosensitive material, whereas, in the multi-layer type photosensitive material, the barrier layer may be formed between the conductive substrate and electric charge generating layer, or between the conductive substrate and electric charge transferring layer, or between the electric charge generating layer and electric charge transferring layer, as far as characteristics of the photosensitive material are not adversely affected. A protective layer may be formed on the surface of the photosensitive material.

As the conductive substrate on which the photosensitive layer is formed, for example, various materials having the conductivity can be used. The substrate includes, for example, conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength on use.

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, and ultrasonic dispersing equipment to prepare a dispersion, and then the resulting dispersion is coated by using a known means and dried.

As the solvent for preparing the dispersion, various organic solvents can be used. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cylohexanone; esters such as ethyl acetate and methyl acetate; and dimethylformaldehyde, dimethylformamide and dimethyl sulfoxide. These solvents can be used alone, or two or more kinds of them can be used in combination.

To improve the dispersion properties of the electric charge transferring material and electric charge generating material, and the smoothness of the surface of the photosensitive layer, for example, surfactants and leveling agents may be added.

EXAMPLES

The following Synthesis Examples, Examples and Comparative Examples further illustrate the present invention in detail.

Synthesis of Quinone Derivative

Synthesis Example 1

Dichloromethane solution (25 mL) containing oxalylchloride (1.0 mL, 11 mmol) was added in a four necked-flask (100 mL); dichloromethane solution (15 mL) containing DMSO (1.7 ml, 22 mmol) was added in a dropping-funnel; and dichloromethane solution (10 mL) containing 10 mL of the compound represented by the following formula (2-1):

(2-1)

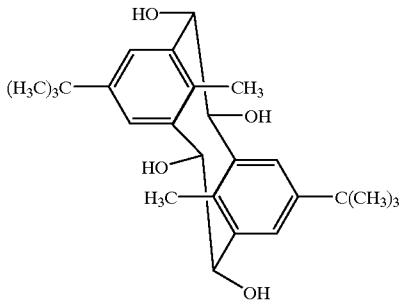

in another dropping-funnel. The DMSO solution was added dropwise to the oxalylchloride solution with stirring. After stirring for 30 minutes, triethylamine (7.0 mL, 50 mmol) was added dropwise and stirred for 2 hours. The resulting reaction solution was added to water, the organic layer was extracted with chloroform and purified by a column chromatography to obtain 4.4 mmol (yield 44%, melting point:190~194° C.) of a quinone derivative (thereafter, referred to as the quinone derivative (1-1)) represented by the following formula (1-1):

(1-1)

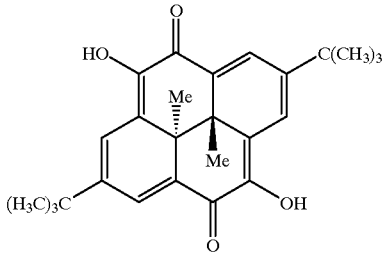

Synthesis Example 2

In the same manner as in of synthesis Example 1, except that a compound represented by the following formula (2-2):

(2-2)

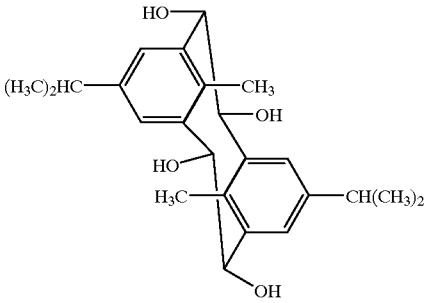

was used in place of the compound (2-1) in Synthesis Example 1, the reaction was conducted to obtain 4.2 mmol (yield 42%, melting point:196~199° C.) of a quinone derivative represented by the formula (1-2):

(1-2)

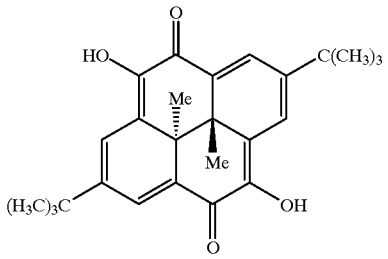

Synthesis Example 3

In the same manner as in of Synthesis Example 1, except that a compound represented by the following formula (2-3):

(2-3)

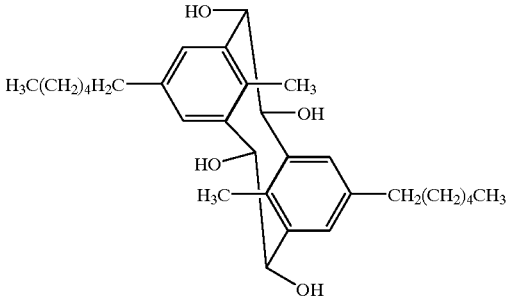

was used in place of the compound (2-1) in Synthesis Example 1, the reaction was conducted to obtain 4.0 mmol (yield 40%, melting point:187~191° C.) of a quinone derivative represented by the formula (1-3):

(1-3)

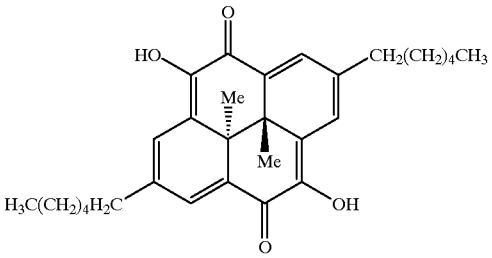

Production of Electrophotosensitive Material

Example 1

Five parts by weight of an X type metal-free phthalocyanine (CG-1) as the electric charge generating material, 100 parts by weight of polycarbonate as the binder resin, 800 parts by weight of tetrahydrofuran, 50 parts by weight of N,N,N',N'-tetrakis(3-methylphenyl)-3,3'-diaminobenzidine as the hole transferring agent, and 30 parts by weight of the quinone derivative (1-1) as the electron transferring material were mixed and dispersed using a ball mill for 50 hours to prepare a coating solution for single-layer type photosensitive material. Then, a conductive substrate (alumina sheet) was coated with the above coating solution by a wirebar, followed by hot-air drying at 100° C. for 60 minutes to produce a single-layer type electrophotosensitive material having a photosensitive layer of 20 $\mu$m in film thickness.

Example 2

In the same manner as in Example 1, except that 3 parts by weight of p-benzoquinone was used as the electron acceptor, a single-layer type electrophotosensitive material was produced.

Example 3

In the same manner as in Example 1, except that 3 parts by weight of 2,6-di-t-butylbenzoquinone was used as the electron acceptor, a single-layer type electrophotosensitive material was produced.

Example 4

In the same manner as in Example 1, except that 3 parts by weight of 3,5-dimethyl-3',5'-di-t-butyl-4,4'-diphenoquinone was used as the electron acceptor, a single-layer type electrophotosensitive material was produced.

Example 5

In the same manner as in Example 1, except that 3 parts by weight of 3,3',5,5'-tetra-t-butyl-4,4'-diphenoquinone was used as the electron acceptor, a single-layer type electrophotosensitive material was produced.

Example 6

Hundred parts by weight of an X type metal-free phthalocyanine (CG-1) as the electric charge generating material, 100 parts by weight of polyvinylbutyral as the binder resin and 2000 parts by weight of tetrahydrofuran were mixed and dispersed using a ball mill for 50 hours to prepare a coating solution for electric generating layer. Then, a conductive substrate (alumina sheet) was coated with the resulted coating solution by a wire bar, followed by hot-air drying at 100° C. for 60 minutes to form an electric generating layer having film thickness of 1 $\mu$m.

Then, 100 parts by weight of the quinone derivative (1-1) as the electron transferring material and 100 parts by weight of polycarbonate as the binder resin were mixed and dispersed together with 800 parts by weight of toluene using a ball mill for 50 hours to prepare a coating solution for electric transferring layer. Then, the coating solution was coated on the above electric generating layer by a wire bar, followed by hot-air drying at 100° C. for 60 minutes to form an electric transferring layer having film thickness of 20 $\mu$m produce. Thus, a multi-layer type photosensitive material was produced.

Example 7

In the same manner as in Example 1, except that the quinone derivative [hereinafter referred to as the quinone derivative (1-2)] represented by the following formula (1-2):

(1-2)

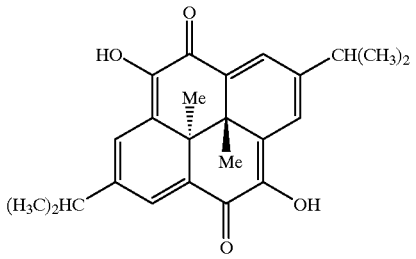

was used as the electron transferring material in place of the quinone derivative (1-1), a single-layer type electrophotosensitive material was produced.

Example 8

In the same manner as in Example 2, except that the quinone derivative (1-2) was used as the electron transferring material in place of the quinone derivative (1-1), a single-layer type electrophotosensitive material was produced.

Example 9

In the same manner as in Example 3, except that the quinone derivative (1-2) was used as the electron transferring material in place of the quinone derivative (1-1), a single-layer type electrophotosensitive material was produced.

Example 10

In the same manner as in Example 4, except that the quinone derivative (1-2) was used as the electron transferring material in place of the quinone derivative (1-1), a single-layer type electrophotosensitive material was produced.

Example 11

In the same manner as in Example 5, except that the quinone derivative (1-2) was used as the electron transferring material in place of the quinone derivative (1-1), a single-layer type electrophotosensitive material was produced.

Example 12

In the same manner as in Example 6, except that the quinone derivative (1-2) was used as the electron transferring material in place of the quinone derivative (1-1), a single-layer type electrophotosensitive material was produced.

Example 13

In the same manner as in Example 1, except that the quinone derivative [hereinafter referred to as the quinone derivative (1-3)] represented by the following formula (1-3):

(1-3)

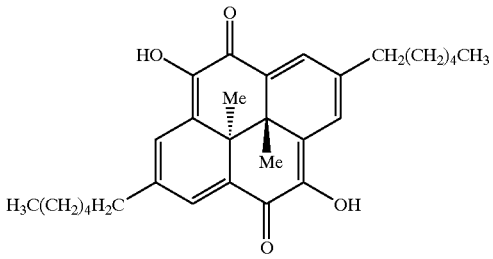

was used as the electron transferring material in place of the quinone derivative (1-1), a single-layer type electrophotosensitive material was produced.

Example 14

In the same manner as in Example 2, except that the quinone derivative (1-3) was used as the electron transferring material in place of the quinone derivative (1-1), a single-layer type electrophotosensitive material was produced.

Example 15

In the same manner as in Example 3, except that the quinone derivative (1-3) was used as the electron transferring material in place of the quinone derivative (1-1), a single-layer type electrophotosensitive material was produced.

Example 16

In the same manner as in Example 4, except that the quinone derivative (1-3) was used as the electron transferring material in place of the quinone derivative (1-1), a single-layer type electrophotosensitive material was produced.

Example 17

In the same manner as in Example 5, except that the quinone derivative (1-3) was used as the electron transferring material in place of the quinone derivative (1-1), a single-layer type electrophotosensitive material was produced.

Example 18

In the same manner as in Example 6, except that the quinone derivative (1-3) was used as the electron transferring material in place of the quinone derivative (1-1), a single-layer type electrophotosensitive material was produced.

Comparative Example 1

In the same manner as in Example 1, except that the compound [hereinafter referred to as the compound (3)] represented by the following formula (3):

(3)

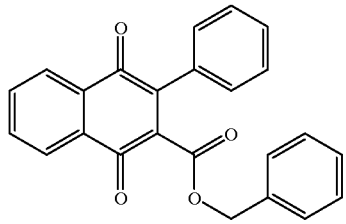

was used as the electron transferring material in place of the quinone derivative (1-1), a single-layer type electrophotosensitive material was produced.

Comparative Example 2

In the same manner as in Example 2, except that the compound (3) was used as the electron transferring material in place of the quinone derivative (1-1), a single-layer type electrophotosensitive material was produced.

Comparative Example 3

In the same manner as in Example 3, except that the compound (3) was used as the electron transferring material in place of the quinone derivative (1-1), a single-layer type electrophotosensitive material was produced.

Comparative Example 4

In the same manner as in Example 4, except that the compound (3) was used as the electron transferring material in place of the quinone derivative (1-1), a single-layer type electrophotosensitive material was produced.

Comparative Example 5

In the same manner as in Example 5, except that the compound (3) was used as the electron transferring material in place of the quinone derivative (1-1), a single-layer type electrophotosensitive material was produced.

Comparative Example 6

In the same manner as in Example 6, except that the compound (3) was used as the electron transferring material in place of the quinone derivative (1-1), a laminated-layer type electrophotosensitive material was produced.

Comparative Example 7

In the same manner as in Example 1, except that the compound [hereinafter referred to as the compound (4)] Represented by the following formula (4):

(4)

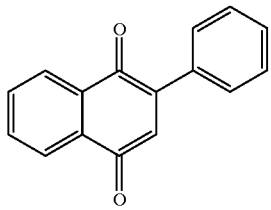

Comparative Example 8

In the same manner as in Example 2, except that the compound (4) was used as the electron transferring material in place of the quinone derivative (1-1), a single-layer type electrophotosensitive material was produced.

Comparative Example 9

In the same manner as in Example 3, except that the compound (3) was used as the electron transferring material in place of the quinone derivative (1-1), a single-layer type electrophotosensitive material was produced.

Comparative Example 10

In the same manner as in Example 4, except that the compound (4) was used as the electron transferring material in place of the quinone derivative (1-1), a single-layer type electrophotosensitive material was produced.

Comparative Example 11

In the same manner as in Example 5, except that the compound (4) was used as the electron transferring material in place of the quinone derivative (1-1), a single-layer type electrophotosensitive material was produced.

Comparative Example 12

In the same manner as in Example 6, except that the compound (4) was used as the electron transferring material in place of the quinone derivative (1-1), a multi-layer type electrophotosensitive material was produced. <Evaluation Test>

Using a drum sensitivity tester (manufactured by GENTEC Co.), a voltage was applied on the surface of each photosensitive material to charge the surface at +700±20V and an initial surface potential $V_0$(V) was measured. Then, monochromic light having a wavelength of 780 nm (half-width: 20 nm, light intensity I: 16 $\mu$W/cm$^2$) from white light of a halogen lamp as an exposure light source through a band-pass filter was irradiated on the surface of each photosensitive material (irradiation time: 80 mseconds) and a surface potential at the time at which 330 mseconds have passed since the beginning of exposure was measured as a residual potential $V_r$ (unit: V).

Measurement results of residual potential Vr (V) are shown in Table 1 in relation of kinds of electric charge generating material, hole transferring material, electron transferring material and electron acceptor used in the above Examples and Comparative Examples In Table 1, the abbreviations are used as follows:

E.C.G.M: Electric charge generating material

H.T.A: Hole transferring material

E.T.A: Electron transferring material

E.A: Electron acceptor

R.P: Residual potential

Ex.: Example

Co.Ex.: Comparative Example

TABLE 1

| | Type | E. C. G. M | H. T. A | E. T. M | E. A | R. P (Vr) |
|---|---|---|---|---|---|---|
| Ex. 1 | Single | CG-1 | E | 1–1 | — | 160 |
| Ex. 7 | Single | CG-1 | E | 1–2 | — | 165 |
| Ex. 13 | Single | CG-1 | E | 1–3 | — | 150 |
| Co. Ex. 1 | Single | CG-1 | E | 5 | — | 170 |
| Co. Ex. 7 | Single | CG-1 | E | 6 | — | 305 |
| Ex. 2 | Single | CG-1 | E | 1–1 | A | 120 |

TABLE 1-continued

| | Type | E. C. G. M | H. T. A | E. T. M | E. A | R. P (Vr) |
|---|---|---|---|---|---|---|
| Ex. 3 | Single | CG-1 | E | 1–1 | B | 119 |
| Ex. 4 | Single | CG-1 | E | 1–1 | C | 110 |
| Ex. 5 | Single | CG-1 | E | 1–1 | D | 105 |
| Ex. 8 | Single | CG-1 | E | 1–2 | A | 122 |
| Ex. 9 | Single | CG-1 | E | 1–2 | B | 122 |
| Ex. 10 | Single | CG-1 | E | 1–2 | C | 113 |
| Ex. 11 | Single | CG-1 | E | 1–2 | D | 109 |
| Ex. 14 | Single | CG-1 | E | 1–3 | A | 117 |
| Ex. 15 | Single | CG-1 | E | 1–3 | B | 117 |
| Ex. 16 | Single | CG-1 | E | 1–3 | C | 108 |
| Ex. 17 | Single | CG-1 | E | 1–3 | D | 105 |
| Co. Ex. 2 | Single | CG-1 | E | 3 | A | 130 |
| Co. Ex. 3 | Single | CG-1 | E | 3 | B | 130 |
| Co. Ex. 4 | Single | CG-1 | E | 3 | C | 123 |
| Co. Ex. 5 | Single | CG-1 | E | 3 | D | 123 |
| Co. Ex. 8 | Single | CG-1 | E | 4 | A | 295 |
| Co. Ex. 9 | Single | CG-1 | E | 4 | B | 290 |
| Co. Ex. 10 | Single | CG-1 | E | 4 | C | 290 |
| Co. Ex. 11 | Single | CG-1 | E | 4 | D | 285 |
| Ex. 6 | Multi | CG-1 | — | 1–3 | — | 245 |
| Ex. 12 | Multi | CG-1 | — | 1–3 | — | 245 |
| Ex. 18 | Multi | CG-1 | — | 1–3 | — | 245 |
| Co. Ex. 6 | Multi | CG-1 | — | 3 | — | 260 |
| Co. Ex. 12 | Multi | CG-1 | — | 4 | — | 410 |

In a single-layer type photosensitive material, as is apparent from each comparison of Examples and Comparative Examples in each of photosensitive materials containing no electron acceptor (Examples 1,7 and 13, Comparative Examples 1 and 7) and photosensitive materials containing electron acceptor (Examples 2 to 5, 8 to 11, 14 to 17, and Comparative Examples 2 to 5 and 8 to 11), photosensitive materials of Examples show lower residual potential (Vr) than those of Comparative Examples. Furthermore, in multi-layer type photosensitive materials, it is shown that products of Examples 6, 12 and 14 show lower residual potential than those of Comparative Examples 6 and 12.

In Table 1, A represents p-benzoquinone, B represents 2,6-di-t-butylbenzoquinone, C represents 3,5-dimethyl-3',5'-di-t-butyl-4,4'-diphenoquinone, D represents 3,3',5,5'-tetra-t-butyl-4,4'-diphenoquinone, and E represents N,N,N',N'-tetrakis(3-methylphenyl)-3,3'-diaminobezidine. Other materials are shown according to their formula numbers or compound numbers.

The disclosure of japanese patent application No. 2000-92930, filed on Mar. 28, 2000, is incorporated herein by reference.

What is claimed is:

1. An electrophotosensitive material comprising a conductive substrate and a photosensitive layer containing an electric charge generating material formed on the conductive substrate, wherein the photosensitive layer contains a quinone derivative represented by the general formula (1):

(1)

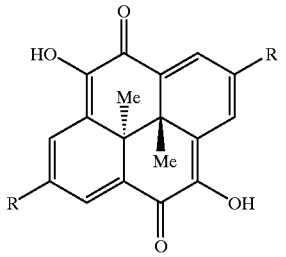

wherein R represents a hydrogen atom or an alkyl group having 3 to 6 carbon atoms and Me represents a methyl group, as an electron transferring material.

2. The electrophotosensitive material according to claim 1, wherein said photosensitive layer further contains an electron acceptor.

3. The electrophotosensitive material according to claim 1, wherein said photosensitive layer is a single layer containing at least a binder resin, said electric charge generating material, a hole transferring material, and 5 to 100 parts by weight of the quinone derivative represented by the general formula (1) based on 100 parts by weight of the binder resin.

4. The electrophotosensitive material according to claim 1, wherein said photosensitive layer comprises at least an electric charge generating layer and an electric charge transferring layer, wherein said electric charge generating layer contains said electric charge generating material and said electric charge transferring layer contains at least a binder resin and 10 to 500 parts by weight of the quinone derivative represented by the general formula (1) based on 100 parts by weight of the binder resin.

* * * * *